US008651757B2

(12) United States Patent
Inoue

(10) Patent No.: US 8,651,757 B2
(45) Date of Patent: Feb. 18, 2014

(54) PRINTER

(75) Inventor: Nobuhiro Inoue, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 12/912,828

(22) Filed: Oct. 27, 2010

(65) Prior Publication Data

US 2011/0107932 A1 May 12, 2011

(30) Foreign Application Priority Data

Nov. 12, 2009 (JP) ..... 2009-258621

(51) Int. Cl.
*B41J 15/04* (2006.01)
*B41J 3/39* (2006.01)
*B41J 11/00* (2006.01)

(52) U.S. Cl.
USPC ..... 400/691; 400/648; 400/693; 347/108

(58) Field of Classification Search
USPC ..... 400/56, 648, 691–693; 347/8, 108
See application file for complete search history.

(56) References Cited

U.S. PATENT DOCUMENTS 4,681,468 A * 7/1987 Kallin et al. ..... 400/692
6,022,158 A 2/2000 Nakayama et al.
6,155,730 A 12/2000 Nakayama et al.
7,563,045 B2 * 7/2009 Nagata ..... 400/693
8,157,462 B2 * 4/2012 Hirabayashi ..... 400/693.1
8,197,060 B2 * 6/2012 Maekawa ..... 347/108
2009/0096854 A1 4/2009 Maekawa

FOREIGN PATENT DOCUMENTS

JP 02041445 A 2/1990
JP 07042046 A 2/1995
JP 07184725 A 7/1995
JP 10278369 A 10/1998
JP 2001070062 A 3/2001
JP 2001-158141 * 6/2001 ..... B41J 15/04
JP 2001-205896 * 7/2001 ..... B41J 29/13
JP 2001-213552 * 8/2001 ..... B65H 19/12
JP 2007175911 A 7/2007
JP 2009095993 A 5/2009

* cited by examiner

*Primary Examiner* — Ren Yan
*Assistant Examiner* — Marissa Ferguson Samreth
(74) *Attorney, Agent, or Firm* — Lowe Hauptman & Ham, LLP

(57) ABSTRACT

A platen support mechanism that movably supports a platen unit to which a platen is attached has a platen positioning mechanism that positions the platen unit in a specific posture at four locations, bosses that protrude from both sides at the front in the front-back direction of the printer, and shaft ends that protrude from both sides at the back in the front-back direction of the printer. The platen unit is thereby positioned in a specific posture at the closed position regardless of play in the platen support mechanism. As a result, the platen is positioned to the printing position in a specific posture with a constant gap to the nozzle surface of the print head.

10 Claims, 15 Drawing Sheets

PRINTER

RELATED APPLICATIONS

The present application is based on, and claims priority from, Japanese Application Number 2009-258621, filed Nov. 12, 2009, the disclosure of which is hereby incorporated by reference herein in its entirety.

BACKGROUND

1. Technical Field

The present invention relates to a printer that can move a platen that defines the printing position where a print head prints on a recording medium to a position removed from the printing position so that the recording medium transportation path is open at the printing position. More particularly, the invention relates to a printer that can position a platen movably supported by a platen support mechanism to the printing position in a specific posture.

2. Related Art

When loading roll paper in a roll paper printer, the cover of the roll paper compartment must be opened, the roll paper loaded, and the recording paper must be pulled from the roll and threaded through the recording paper transportation path passed the printing position of the print head. To simplify loading the recording paper, the platen, which determines the printing position, may be configured to move with the cover so that when the cover opens the platen separates from the printing position (from the print head disposed on the printer housing side) and the recording paper transportation path is open.

Japanese Unexamined Patent Appl. Pub. JP-A-2009-95993 and Japanese Unexamined Patent Appl. Pub. JP-A-2007-175911 teach platen support mechanisms that support a platen frame on which the platen is carried by means of a four joint parallel linkage mechanism disposed on each side of the platen frame. This platen support mechanism causes the platen frame to move in the front-back direction of the printer between a closed position where the platen is positioned to the printing position and an open position separated from the closed position while the platen frame, and more specifically the platen, is held in a constantly horizontal posture.

A problem with these platen support mechanisms that use a linkage mechanism is that play develops in the joints between the links over time. As a result, when the cover is closed and the platen is positioned to the printing position, play in the platen support mechanism may result in the platen or platen frame not being set to the desired specific posture. If the platen is positioned at an angle to the print head instead of in the desired horizontal posture, and the print head is an inkjet head, print quality will drop because the gap between the recording paper conveyed over the platen surface and the ink nozzle surface of the print head is not constant. In addition, if the platen frame is not supported in the specified position when the platen is positioned to the printing position, parts on the platen frame may interfere with the print head, for example, and cause other problems.

With the platen support mechanism taught in JP-A-2009-95993, a pair of protrusions are formed at the front part of the platen frame on opposite sides widthwise to the printer, and the platen is positioned to the printing position by engaging the pair of protrusions in matching channels disposed to the printer frame when the cover closes. However, because this positioning method cannot control the inclination of the platen frame in the front-back direction of the printer when positioning the platen, the platen frame is not supported in the specified posture and the platen becomes tilted in the front-back direction of the printer when play develops in the platen support mechanism.

With the platen support mechanism taught in JP-A-2007-175911, a guide roller is disposed at the back end part of the platen frame on one side widthwise to the printer, and the platen is positioned to the printing position when the cover is closed by causing the guide roller to ride onto a positioning member formed on the printer frame. However, because this positioning method cannot control the inclination of the platen frame in the front-back direction of the printer when positioning the platen, the platen frame is not supported in the specified posture and the platen becomes tilted in the front-back direction of the printer when play develops in the platen support mechanism.

SUMMARY

A printer according to the present invention can position a platen that is supported movably from the printing position by a platen support mechanism to the printing position in a specific desirable posture regardless of play in the platen support mechanism.

A first aspect of the invention is a printer having a platen that determines a printing position of a print head; a platen frame on which the platen is mounted; and a platen support mechanism that supports the platen frame movably to a closed position where the platen is positioned to the printing position, and an open position separated from the closed position, and has a platen positioning mechanism that positions the platen frame at four places so that the platen frame is in a predetermined posture at the closed position, the four places including a first front position and a second front position on opposite sides at the front in the opening direction, and a first back position and a second back position on opposite sides at the back in the opening direction.

The platen support mechanism according to this aspect of the invention has a platen positioning mechanism that positions the platen frame in a specific posture at four locations when at the closed position, that is, both sides of the front and both sides of the back of the platen frame in the direction in which the platen frame opens. The platen frame is therefore always positioned to the closed position in a specific posture regardless of any play in the platen support mechanism. As a result, because the posture of the platen in the printing position is always controlled to a specific posture, a constant gap can be assured between all parts of the platen surface and the print head. The gap between the recording paper conveyed over the platen surface and the print head is therefore constant, and print quality can be maintained. In addition, because the platen frame is controlled to a specific posture in the closed position, there is no interference between parts on the platen frame and the print head or other parts.

In order for the platen support mechanism to control the path of platen frame movement between the closed position and the open position, the platen positioning mechanism preferably includes a first guide channel formed at the first front position on one side of the platen frame and a first side panel part of the main printer frame opposite the first back position, a second guide channel formed at the second front position on the other side of the platen frame and a second side panel part of the main printer frame opposite the second back position, a first front positioning pin and a first back positioning pin respectively disposed at the first front position and the first back position of the platen frame, a second front positioning pin and a second back positioning pin respectively disposed at the second front position and the second back position; and the first front positioning pin and the first back positioning pin are guided by the first guide channel, and the second front positioning pin and the second back positioning pin are guided by the second guide channel, from an intermediate position of platen frame movement toward the closed position, and are thereby respectively positioned to the first front position and the first back position, and the second front position and the second back position, when the platen frame is in the closed position.

Further preferably, in order to simplify positioning in the closing direction to the closed position of the platen frame, the platen frame is positioned in the closing direction to the closed position by the first back positioning pin contacting the end of the first guide channel in the closing direction of the platen frame and the second back positioning pin contacting the end of the second guide channel in the closing direction of the platen frame.

Yet further preferably, in order to suppress a drop in the rigidity of the main printer frame caused by forming the first and second guide channels, the ends of the first guide channel and the second guide channel in the direction to which the platen frame opens are open ends; the part where the open end of the channel is formed in the first side panel is reinforced by a reinforcing member without interfering with the first front positioning pin and first back positioning pin; and the part where the open end of the channel is formed in the second side panel part is reinforced by a reinforcing member without interfering with the second front positioning pin and second back positioning pin.

In another aspect of the invention, the platen support mechanism has a first front link and a first back link respectively disposed to the first front position and first back position side, and a second front link and a second back link respectively disposed to the second front position and the second back position side, at front and back locations in the opening direction of the platen frame; the first front link and the second front link are compound links rendered by connecting respective first links and second links in series through a first pin joint; the first back link and the second back link are compound links rendered by connecting respective third links and fourth links in series through a second pin joint; a fifth link spans between the first pin joint and the second pin joint; and a six joint parallel linkage mechanism that supports the platen frame on both sides of the platen frame is rendered by the first to fifth links. The path of platen frame movement can be designed more freely if the platen support mechanism has a six joint parallel linkage mechanism.

In a printer according to another aspect of the invention, the platen support mechanism has a first front link and a first back link respectively disposed to the first front position and first back position side, and a second front link and a second back link respectively disposed to the second front position and the second back position side, at front and back locations in the opening direction of the platen frame; and a four joint parallel linkage mechanism that supports the platen frame on both sides of the platen frame is rendered by these links. The platen frame can be made to move along a curved path if the platen support mechanism has a four joint parallel linkage mechanism.

In order to open the recording paper transportation path that conveys recording paper passed the printing position when the access cover for opening and closing a roll paper compartment in which roll paper is stored is opened, a printer according to another aspect of the invention preferably has a roll paper compartment that stores roll paper; and an access cover for opening and closing the roll paper compartment; wherein the platen frame opens and closes in conjunction with opening and closing the access cover.

A printer according to another aspect of the invention has a main frame to which a print head is disposed and which has a first side panel part and second side panel part; and a platen frame that carries a platen that is positioned opposite the print head, can move relative to the main frame, and is disposed between the first side panel part and the second side panel part of the main frame. The platen frame can move to a first position where the platen is opposite the print head, and a second position where the platen is separated from the print head, and includes a first protrusion and a third protrusion that protrude towards the first side panel of the main frame, and a second protrusion and a fourth protrusion that protrude toward the second side panel of the main frame. The first protrusion and the second protrusion are disposed coaxially, and the third protrusion and the fourth protrusion are disposed coaxially. On the first side panel part the main frame has a first guide unit that guides the first protrusion of the platen frame, and a third guide unit that guides the third protrusion of the platen frame; and on the second side panel part has a second guide unit that guides the second protrusion of the platen frame, and a fourth guide unit that guides the fourth protrusion of the platen frame. The first guide unit has a first stop that contacts the first protrusion when the platen frame is positioned at the first position, and the second guide unit has a second stop that contacts the second protrusion when the platen frame is positioned at the first position. When the platen frame is positioned to the first position, the first protrusion is supported by the first guide unit and contacts the first stop, the second protrusion is supported by the second guide unit and contacts the second stop, the third protrusion is supported by the third guide unit, and the fourth protrusion is supported by the fourth guide unit.

EFFECT OF THE INVENTION

The platen support mechanism according to this aspect of the invention has a platen positioning mechanism that positions the platen frame in a specific posture at four locations when at the closed position, that is, both sides of the front and both sides of the back of the platen frame in the direction in which the platen frame opens. The platen frame is therefore always positioned to the closed position in a specific posture regardless of any play in the platen support mechanism. As a result, because the posture of the platen in the printing position is always controlled to a specific posture, a constant gap can be assured between all parts of the platen surface and the print head. The gap between the recording paper conveyed over the platen surface and the print head is therefore constant, and print quality can be maintained. In addition, because the platen frame is controlled to a specific posture in the closed position, there is no interference between parts on the platen frame and the print head or other parts.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet roll paper printer according to the present invention is described below with reference to the accompanying figures.

General Configuration of a Roll Paper Printer

Figure 1:
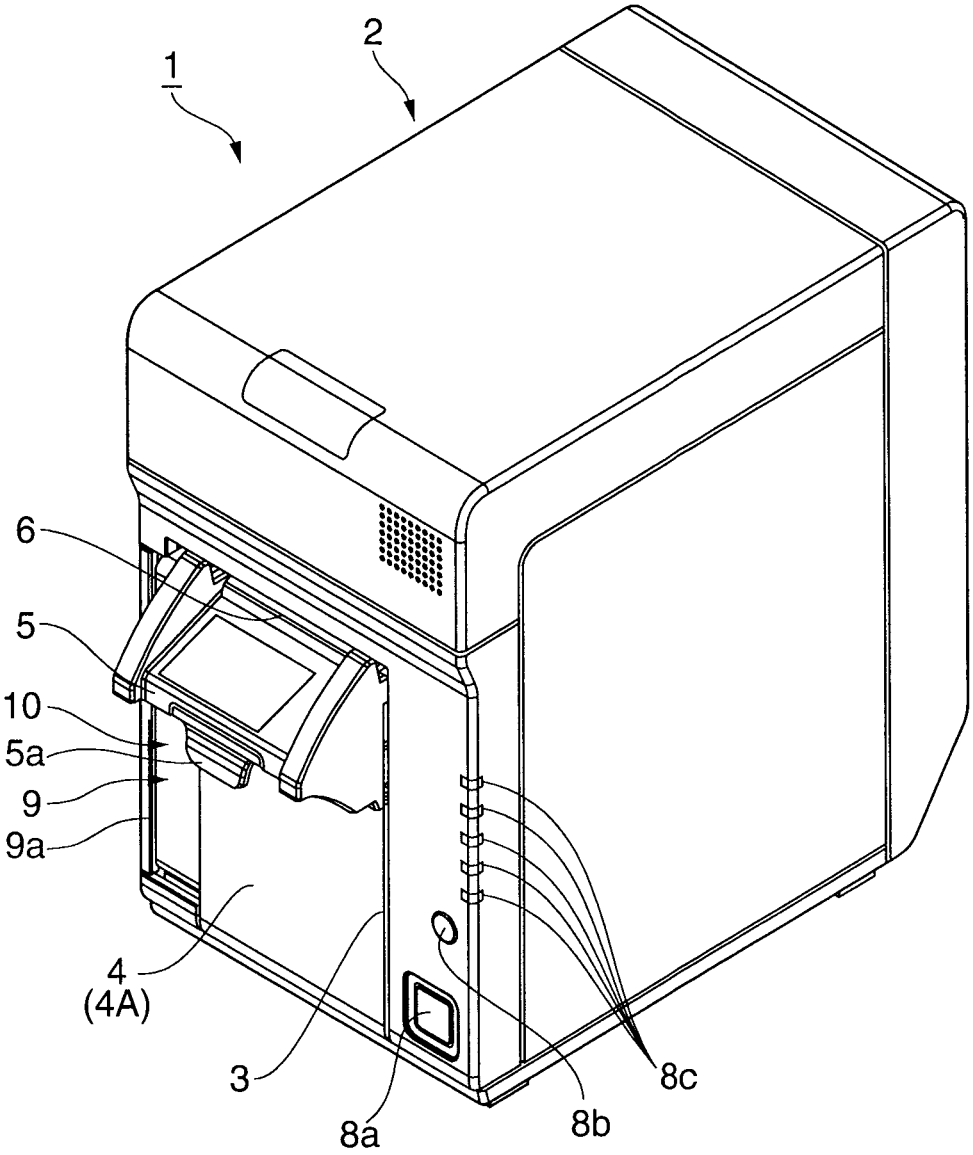
FIG. 1 is an external oblique view of a roll paper printer according to the invention.
Figure 2:
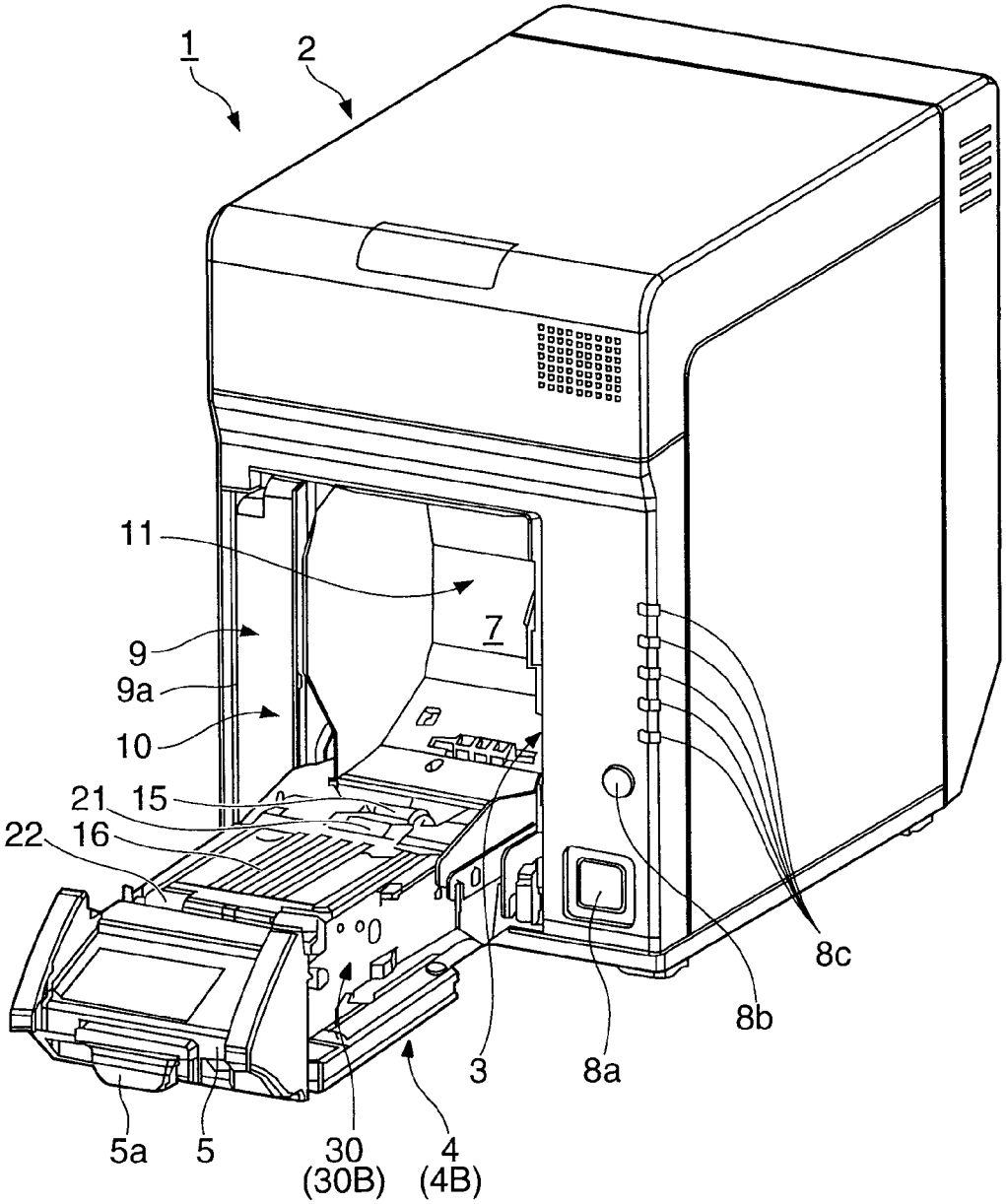
FIG. 2 is an oblique view showing the roll paper printer with the cover open.

The roll paper printer 1 (referred to below as simply a printer) shown in FIG. 1 and FIG. 2 uses plural colors of ink to print in color on a web of recording paper that is delivered from a paper roll. The printer 1 has a generally box-like rectangular case 2 with an opening 3 in the middle front part of the case 2 for loading roll paper. The opening 3 is opened and closed by a cover 4. A recording paper discharge guide 5 is disposed at the top end of the cover 4, and when the cover 4 is closed (is in closed position 4A) a recording paper exit 6 is formed between the discharge guide 5 and the top edge of the opening 3 in the printer case 2.

An operating tab 5*a* is attached protruding down from a position at the front bottom side of the discharge guide 5. When this operating tab 5*a* is pulled out in front of the printer, the cover 4 lock is disengaged. When the lock is disengaged and the operating tab 5*a* is pulled further forward, the cover 4 can be opened forward and down from the closed position 4A shown in FIG. 1 to the open position 4B shown in FIG. 2. When the cover 4 opens, the roll paper compartment 7 formed inside the printer 1 is open, and the roll paper can be loaded or replaced.

A power switch 8*a*, paper feed switch 8*b*, and a plurality of operating indicators 8*c* are disposed in the front of the case 2 on the right side of the cover 4. An opening 9*a* to the ink cartridge loading unit 9 is rendered in the front of the case 2 on the left side of the cover 4, and an ink cartridge 10 storing plural colors of ink is loaded in this ink cartridge loading unit 9.

Figure 3:
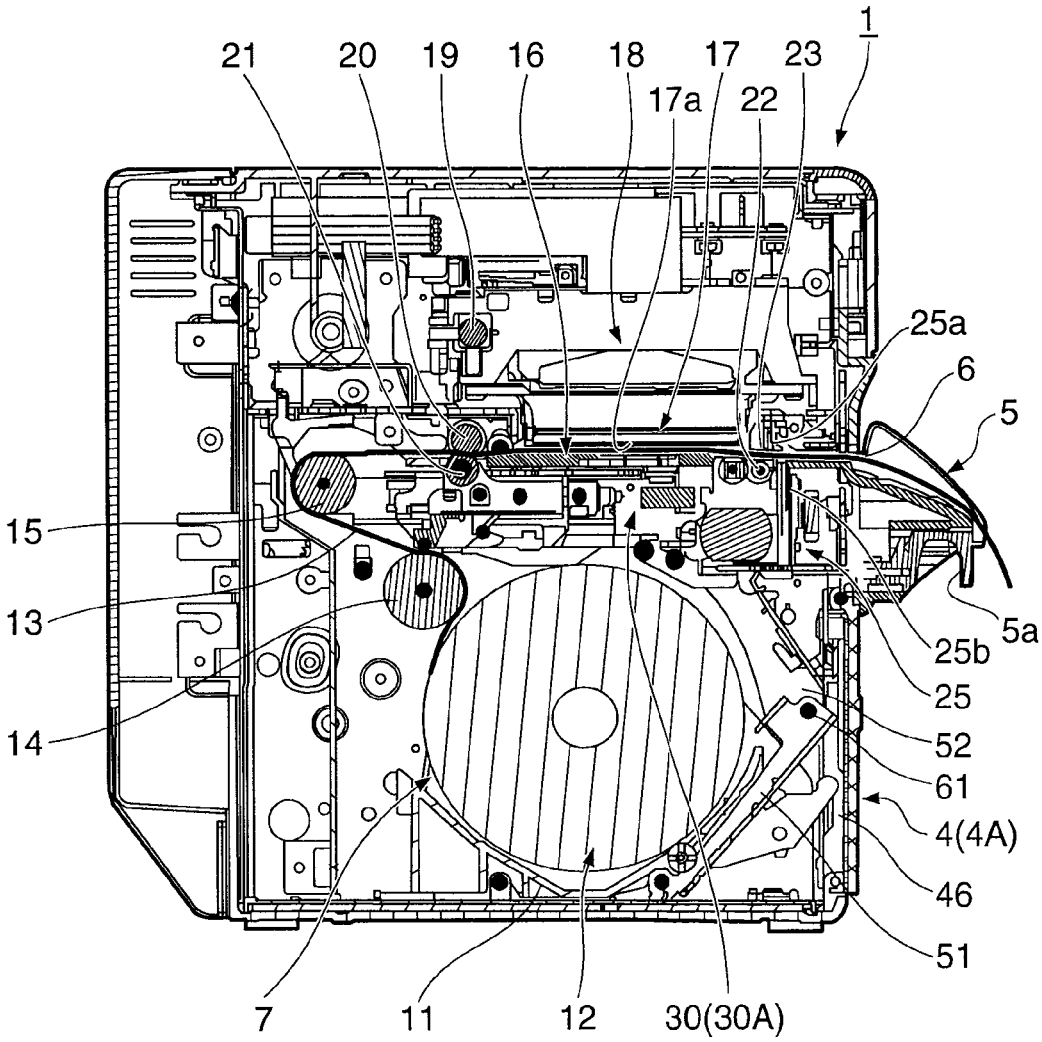
FIG. 3 is a vertical section view showing the internal configuration of the roll paper printer.
Figure 4:
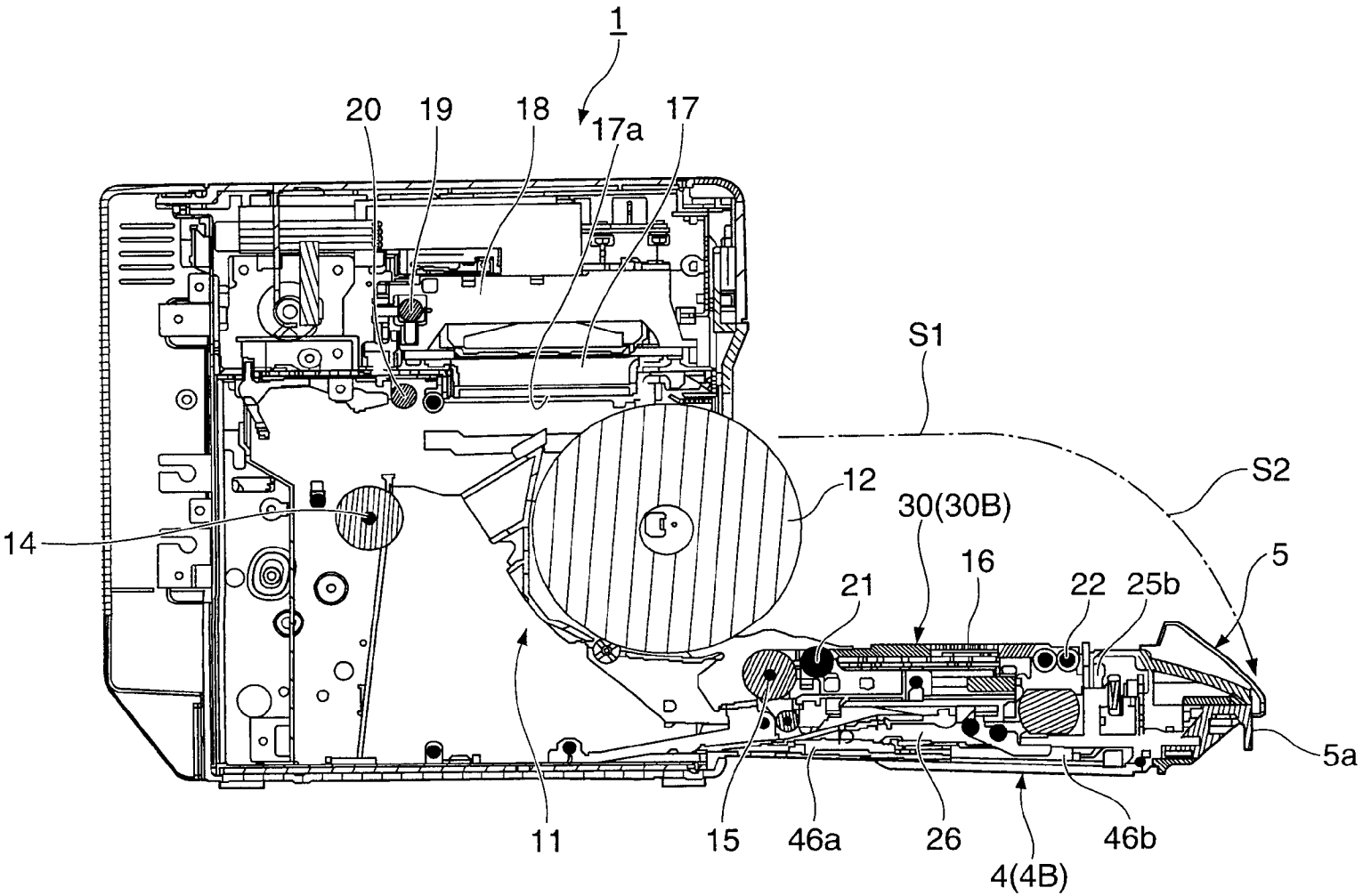
FIG. 4 is a vertical section view showing the internal configuration when the cover of the roll paper printer is open.

The roll paper compartment 7 has a roll paper tray 11 with an arcuate section as shown in FIG. 3 and FIG. 4, and the roll paper 12 is stored freely rotatably on the roll paper tray 11.

A platen 16 and print head 17 (inkjet head) are disposed above the roll paper compartment 7. The print head 17 is mounted on a head carriage 18, and can move bidirectionally widthwise to the printer 1 along a guide shaft 19. The nozzle surface 17*a* of the print head 17 faces the top surface of the platen 16 with a specific gap therebetween.

A paper feed drive roller 20 is disposed behind the platen 16, and a paper feed follower roller 21 is pressed from below to the paper feed drive roller 20. A discharge drive roller 22 is disposed in front of the platen 16, and a discharge follower roller 23 is pressed from above to the discharge drive roller 22.

The web of recording paper 13 pulled from the roll paper 12 is conveyed passed a feed roller 14 and a tension roller 15 disposed behind and above the feed roller 14 toward the platen 16. The recording paper 13 passes between the paper feed drive roller 20 and paper feed follower roller 21, is conveyed passed the printing position defined by the top surface of the platen 16, passes between the discharge drive roller 22 and discharge follower roller 23, and is fed towards the paper exit 6. The recording paper 13 is thus conveyed over the top surface of the platen 16 from the back of the printer to the front. The surface of the recording paper 13 passing the printing position is then printed on by the print head 17. The recording paper 13 fed out from between the discharge drive roller 22 and discharge follower roller 23 is cut widthwise by a cutter mechanism 25 disposed near the paper exit 6.

The cutter mechanism 25 includes a fixed knife 25*a* disposed to a front connecting plate 35 described below, and a movable knife 25*b* disposed to the platen unit 30. The recording paper 13 is conveyed between the fixed knife 25*a* and movable knife 25*b*, and is cut by the movable knife 25*b* moving towards the fixed knife 25*a*. The recording paper slip (not shown in the figure) that is cut off is removed from the paper exit 6 of the printer 1 and issued as a receipt, for example.

Platen Unit

As shown in FIG. 4, the platen 16, paper feed follower roller 21, discharge drive roller 22, and the movable knife 25*b* and movable knife drive mechanism of the recording paper cutter mechanism 25 are mounted on a platen frame 26 and move in unison as a platen unit 30.

The tension roller 15 is mounted on the back end of the platen unit 30, and the discharge guide 5 is attached to the front end of the platen unit 30. The platen unit 30 is normally positioned where the platen 16 defines the printing position of the print head 17, that is, in the closed position 30A shown in FIG. 3.

When the operating tab 5*a* of the discharge guide 5 is pulled forward, a lock not shown disengages and the platen unit 30 can be pulled out to the open position 30B shown in FIG. 4. The platen unit 30 is pulled out along a straight first path of movement S1 from the closed position 30A to the front of the printer, and then travels forward and down along a curved second path of movement S2 to the open position 30B.

The cover 4 is attached to a cover mounting frame 46 connected to the platen unit 30, and opens to the front in conjunction with movement of the platen unit 30 from the closed position 30A to the open position 30B. The roll paper tray 11 of the roll paper compartment 7 also pivots to a position that is tilted a specific angle to the front of the printer as shown in FIG. 4.

Figure 5:
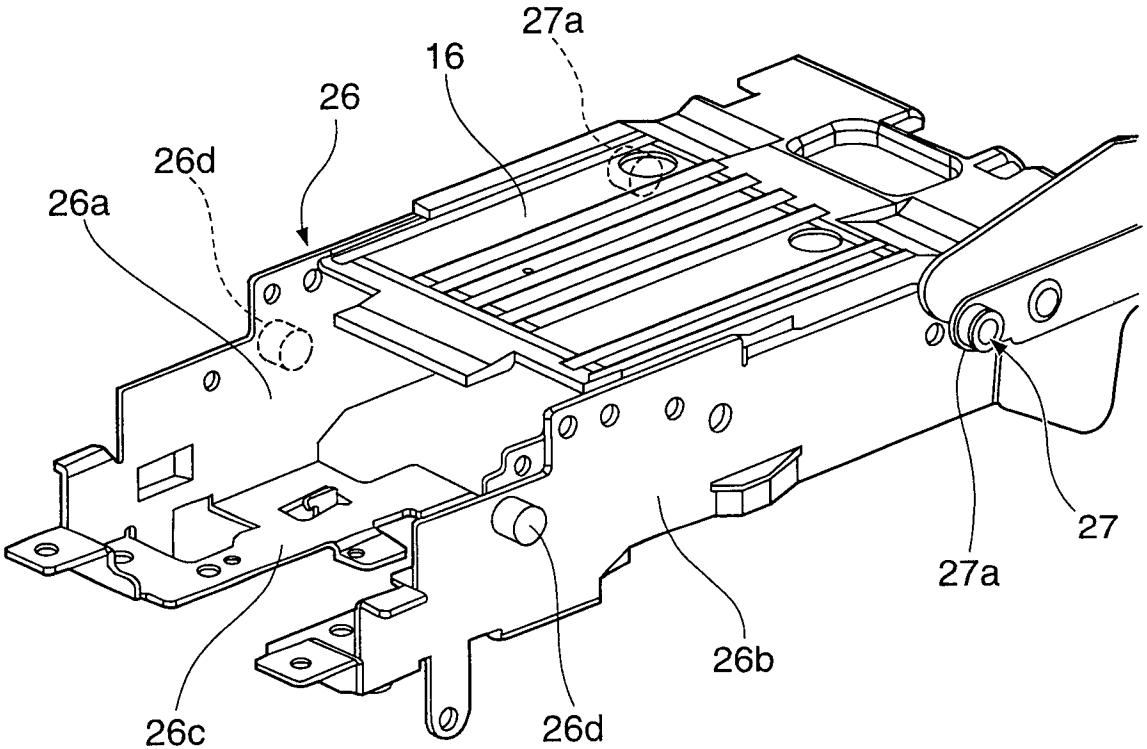
FIG. 5 is an oblique view of the platen frame on which the platen is carried.

As shown in FIG. 5, the platen frame 26 is made from sheet metal, and has a pair of parallel side panels 26*a* and 26*b* that extend in the front-back direction of the printer (the direction of platen frame 26 movement), and a bottom panel 26*c* that spans the front bottom edges of the pair of side panels 26*a* and 26*b*. A pair of bosses 26*d* (front positioning pin, protruding member) are disposed at the front of the pair of side panels 26*a* and 26*b*, and the pair of bosses 26*d* protrude widthwise to the printer at the front of the platen unit 30. A support shaft 27 spans the back ends of the pair of side panels 26*a* and 26*b* widthwise to the printer. The support shaft 27 passes through the pair of side panels 26*a* and 26*b* widthwise to the printer, and the shaft ends 27*a* (back positioning pin, protruding member) protrude widthwise to the printer at the back of the platen unit 30. The platen 16 spans the top parts of the pair of side panels 26*a* and 26*b*, and is positioned between the pair of bosses 26*d* and the support shaft 27 in the front-back direction of the printer.

Main Frame

Figure 6:
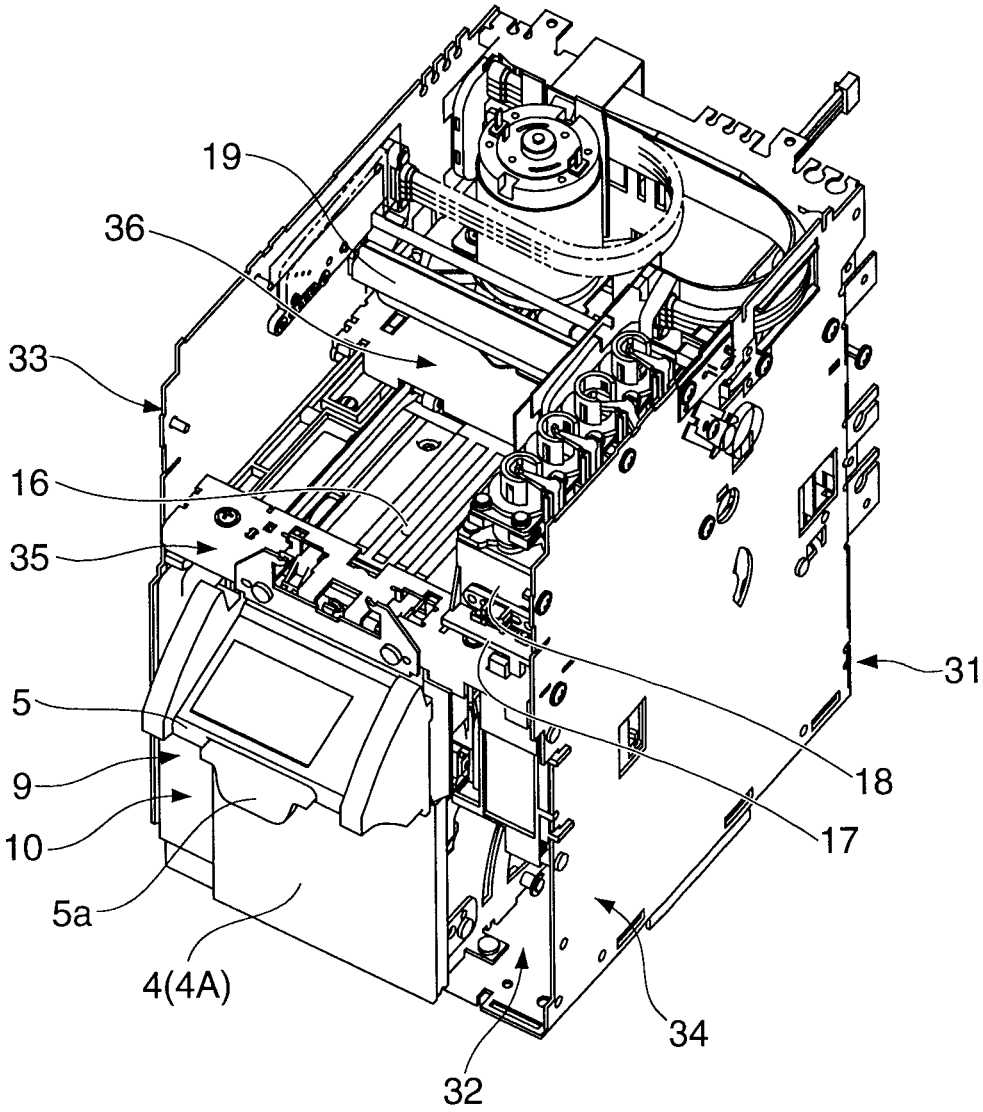
FIG. 6 is an oblique view showing the print mechanism unit of the roll paper printer.

As shown in FIG. 6, the main frame 31 of the printer 1 is made of sheet metal and includes a bottom panel 32 and left and right side panels 33 and 34. The front connecting plate 35 and a rear connecting plate 36 span between the front and back ends, respectively, of the left and right side panels 33 and 34 widthwise to the printer.

Figure 7A:
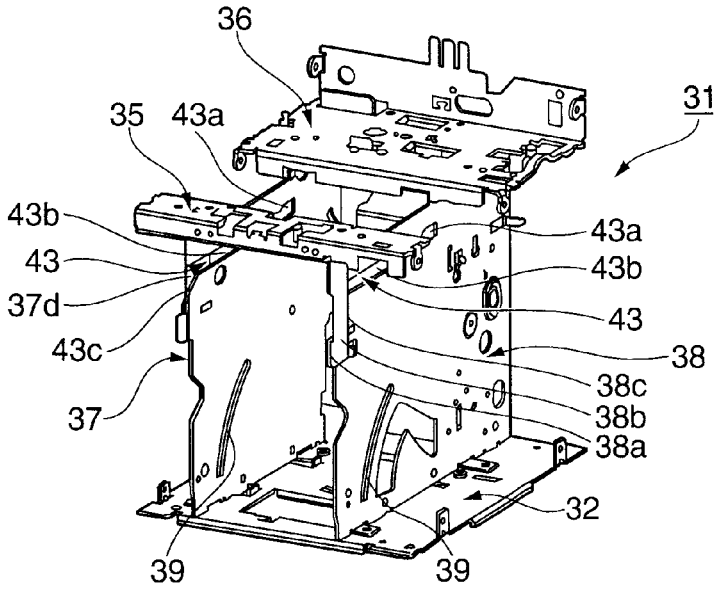
FIG. 7A to FIG. 7C are oblique views showing the main frame of the roll paper printer.
Figure 7B:
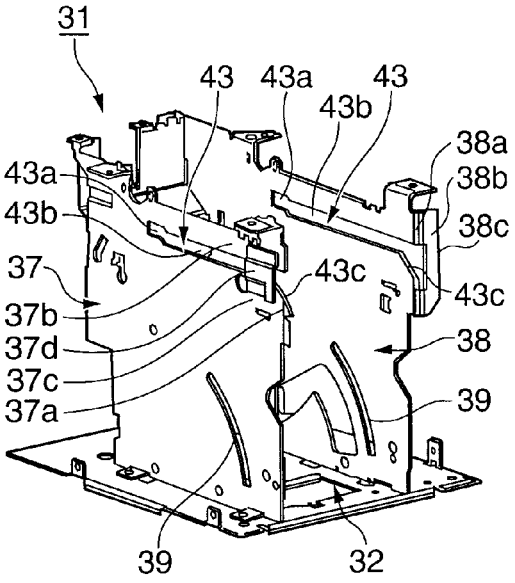
Figure 7C:
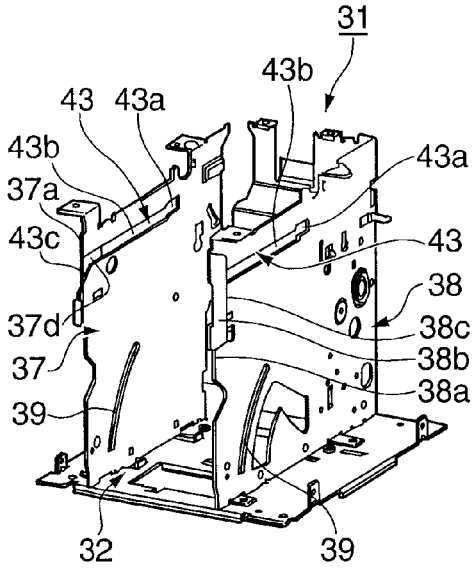

FIG. 7A is an oblique view showing the main frame 31 without the left and right side panels 33 and 34. FIG. 7B and FIG. 7C are left and right side oblique views showing the main frame 31 without the front and rear connecting plates 35 and 36. As shown in these figures, the main frame 31 has left and right inside side panels 37, 38 on the inside of the left and right side panels 33 and 34, and the roll paper compartment 7 (see FIG. 2) is rendered between these inside side panels 37, 38.

Platen Support Mechanism

The platen support mechanism that supports the platen unit 30 movably with the cover 4 from the closed position 30A to the open position 30B is described next. The platen support mechanism is constructed around a six joint parallel linkage mechanism 42 (also called simply a six joint linkage mechanism below).

Figure 8A:
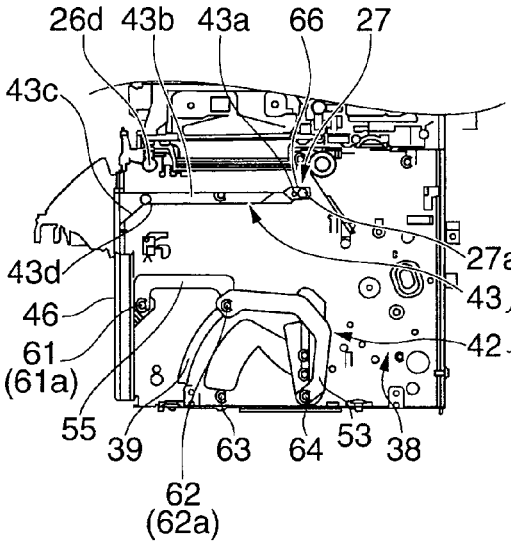
FIG. 8A to FIG. 8D are side views showing the platen support mechanism of the roll paper printer.
Figure 8B:
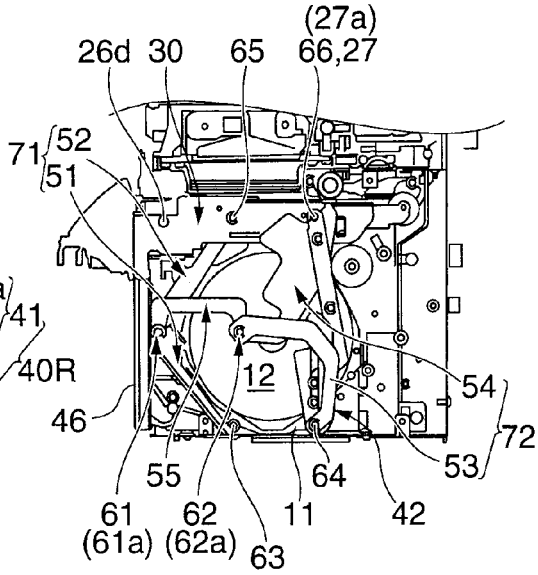
Figure 8C:
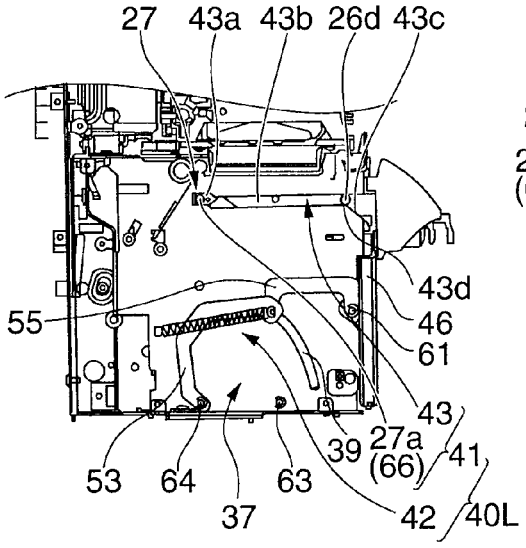
Figure 8D:
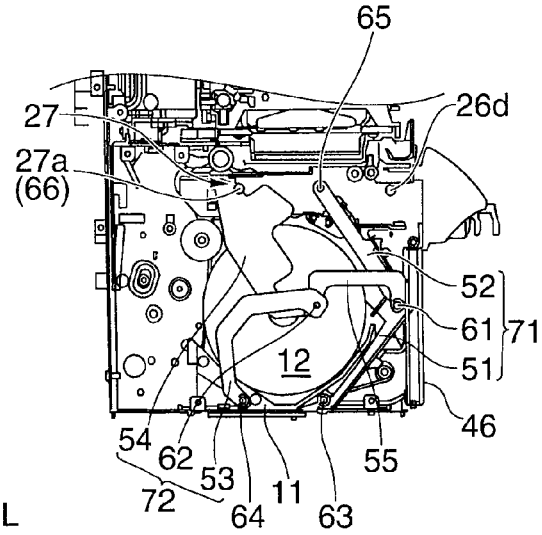

FIG. 8A is a right side view from the outside of the inside side panel 38 on the right side of the main frame 31, and FIG. 8B is a right side view of the main frame 31 when the inside side panel 38 is removed. FIG. 8C is a left side view from the outside of the left inside side panel 37, and FIG. 8D is a left side view when the inside side panel 37 is removed.

Referring to these figures, the platen support mechanism has a right-side platen support mechanism 40R disposed on the side of the right inside side panel 38, and a left-side platen support mechanism 40L disposed on the side of the left inside side panel 37. The right-side platen support mechanism 40R and the left-side platen support mechanism 40L are symmetrical left and right (plane symmetric) and have basically the same construction.

The right-side platen support mechanism 40R has a platen positioning mechanism 41 and a six joint linkage mechanism 42.

The platen positioning mechanism 41 guides the platen unit 30 to an intermediate position from the closed position 30A to the open position 30B along the first path S1, and positions the platen unit 30 in a predetermined specific posture at the closed position 30A. The six joint linkage mechanism 42 holds the platen unit 30 guided along the first path S1 in a specific posture, and moves while holding the platen unit 30 in a specific posture along the curved second path S2 from this intermediate position to the open position 30B.

Platen Positioning Mechanism

The platen positioning mechanism 41 has guide channels 43 that guide the platen unit 30 from the closed position 30A along the straight first path S1 toward the front of the printer.

The guide channels 43 extend toward the back of the printer from the front edges 37*a*, 38*a* of the left and right inside side panels 37 and 38, respectively. Each guide channel 43 has a rear positioning guide channel part 43*a* at the back end of the guide channel 43, a straight guide channel part 43*b* of a specific width extending from the rear positioning guide channel part 43*a* toward the front of the printer, and a curved inclined guide surface 43*c* that slopes down contiguously from the bottom guide surface of the front end part of the straight guide channel part 43*b*. The front end part of the straight guide channel part 43*b* renders a front positioning guide channel part 43*d*.

The bosses 26*d* that protrude to the sides widthwise to the printer at the front of the platen unit 30, the shaft ends 27*a* of the support shaft 27 protruding to the sides widthwise to the printer at the back of the platen unit 30, and the guide channel 43 together render the platen positioning mechanism 41.

More specifically, when the platen unit 30 moves to the closed position 30A, the boss 26*d* (first front-side positioning pin) that protrudes from a position at the front and the shaft end 27*a* (first back-side positioning pin) that protrudes from a position at the back of the platen unit 30 opposite the left inside side panel 37 (first side panel part) are slidably inserted to the platen unit guide channel 43 (first guide channel) in the left inside side panel 37, and the boss 26*d* (second front-side positioning pin) that protrudes from a position at the front and the shaft end 27*a* (second back-side positioning pin) that protrudes from a position at the back of the platen unit 30 opposite the right inside side panel 38 (second side panel part) are slidably inserted to the platen unit guide channel 43 (second guide channel) in the right inside side panel 38. As a result, the platen unit 30 moves along the guide channel 43.

When the platen unit 30 is pushed toward the back of the printer (in the direction in which the platen frame 26 closes) to the closed position 30A, the shaft ends 27*a* at the back of the platen unit 30 ride onto the rear positioning guide channel part 43*a* at the back end of the guide channel 43 and contact the end of the platen unit guide channel 43. The bosses 26*d* at the front of the platen unit 30 simultaneously ride onto the front positioning guide channel part 43*d* at the front end of the straight guide channel part 43*b*. As a result, the platen unit 30 is positioned in a predetermined specific posture at the closed position 30A, and the platen 16 is positioned to the printing position in a posture with a specified gap to the nozzle surface 17*a* of the print head 17.

The right inside side panel 38 has a flange 38*b* that bends to the outside from the front edge 38*a* thereof. The platen unit guide channel 43 is formed with an open end rendered in the part where the flange 38*b* is formed, and extends from this front edge 38*a* toward the back of the printer. The boss 26*d* and shaft end 27*a* can be inserted to the platen unit guide channel 43 from the open end. The flange 38*b* functions as a reinforcing member that suppresses a drop in the rigidity of the inside side panel 38 that results from forming the platen unit guide channel 43.

The platen unit guide channel 43 in the left inside side panel 37 is formed by cutting a channel of a specific length from the front edge 37*a* of the inside side panel 37. On the other inside side panel 37, a reinforcing member 37*d* vertically spans the platen unit guide channel 43 from one inside side panel part 37*b* to the other inside side panel part 37*c* disposed one above the other with the platen unit guide channel 43 therebetween. The reinforcing member 37*d* is recessed to the outside so that it does not interfere with the boss 26*d* and shaft end 27*a* sliding through this platen unit guide channel 43. A drop in the rigidity of the inside side panel 37 can be suppressed by providing this reinforcing member 37*d*.

Note that a configuration in which the guide channel (or guide recess) is rendered on the platen unit 30 side, and the shaft (or protrusion) is formed on the main frame 31 side, could also be used.

Six Joint Linkage Mechanism

The six joint linkage mechanism 42 includes a first compound link 71 (front link) including a first link 51 second link 52 connected in series by a first joint pin 61, a second compound link 72 (back link) including a third link 53 and a fourth link 54 connected in series by a second joint pin 62, and a fifth link 55 connected to the first joint pin 61 of the first compound link 71 and the second joint pin 62 of the second compound link 72.

The bottom end of the first compound link 71 and the bottom end of the second compound link 72 are respectively connected to a third joint pin 63 and fourth joint pin 64 at specific front and back positions separated a specific distance when seen along the front-back direction of the printer (the direction in which the platen unit 30 opens). The third and fourth joint pins 63, 64 are rendered by support rods that extend widthwise to the printer and are attached to the inside side panel 38 or bottom panel 32.

The top end of the first compound link 71 and the top end of the second compound link 72 are similarly respectively connected to a fifth joint pin 65 and sixth joint pin 66 disposed at places on the side of the platen unit 30 separated a specific distance in the front-back direction of the printer. The rear sixth joint pin 66 is rendered by the end 27*a* of the support rod 27 that can slide along the guide channel 43.

The six joint linkage mechanism 42 is thus rendered by first to fifth links 51 to 55, and first to sixth joints 61 to 66. More specifically, the length of the line segment connecting the first pin joint 61 and second joint 62, the length of the line segment connecting the third joint 63 and fourth joint 64, and the length of the line segment connecting the fifth joint 65 and sixth joint 66 are equal; the length of the line segment connecting the first joint 61 and the third joint 63, and the length of the line segment connecting the second joint 62 and the fourth joint 64 are equal; and the length of the line segment connecting the first joint 61 and the fifth joint 65, and the length of the line segment connecting the second joint 62 and the sixth joint 66, are equal. In addition, the line segments connecting the first joint 61 and second joint 62, the third joint 63 and the fourth joint 64, and the fifth joint 65 and sixth joint 66 are parallel. The six joint parallel linkage mechanism 42 is thus rendered.

Note that in this embodiment of the invention the two first links 51 disposed on the left and right sides are rendered in unison (that is, are rendered as a single part), and the second link 52 is likewise rendered from two second links disposed on the left and right sides formed in unison (that is, formed as a single part).

When the platen unit 30 is in the closed position 30A, the first and second compound links 71, 72 of the six joint linkage mechanism 42 curve toward the front. More specifically, the first compound link 71 is curved with the first joint 61 connecting the first link 51 and second link 52 of the first compound link 71 positioned closer to the front of the printer than the third and fifth joints 63, 65. Likewise, the second compound link 72 is curved with the second joint 62 connecting the third link 53 and fourth link 54 of the second compound link 72 positioned closer to the front of the printer than the fourth and sixth joints.

The curved front first compound link 71 and rear second compound link 72 are connected to each other by the fifth link 55. Therefore, when the platen unit 30 slides forward guided by the guide channel 43, that is, while the elevation (height) of the sixth joint 66 (end 27*a*) of the six joint linkage mechanism 42 is controlled by the guide channel 43, the platen unit 30 slides forward while held in a constant posture.

As the platen unit 30 slides forward, the first and second compound links 71, 72 gradually extend from the curved position. More specifically, the first and second compound links 71, 72 are configured so that they are fully extended when the end 27*a* of the support rod 27 that renders the sixth joint 66 at the top end of the second compound link 72 has moved from the front end of the straight guide channel part 43*b* of the guide channel 43 to the inclined guide surface 43*c* (at an intermediate position between the closed position 30A and open position 30B).

The lengths of the first and second compound links 71, 72, that is, the length when the compound links are fully extended from the curved position, are the same. In other words, the maximum distance between the top and bottom fifth joint 65 and third joint 63 of the first compound link 71 when the first compound link 71 is fully extended (the length of the line segment connecting the third joint (contact point) 63 and fifth joint (contact point) 65 when the first, third, and fifth contact points 61, 63, 65 are positioned on the same line), and the maximum distance between the top and bottom sixth joint 66 and fourth joint 64 of the second compound link 72 when the second compound link 72 is fully extended (the length of the line segment connecting the fourth joint (contact point) 64 and sixth joint (contact point) 66 when the second, fourth, and sixth contact points 62, 64, 66 are positioned on the same line), are equal.

The first compound link 71 is configured so that when fully extended the first link 51 and second link 52 are mutually engaged and cannot curve in the opposite direction (to the back). Therefore, after the first and second compound links 71, 72 are fully extended, the six joint linkage mechanism 42 functions as a four joint parallel linkage mechanism. As a result, the platen unit 30 thereafter moves along the curved second path S2 defined by the linkage length of the first and second compound links 71, 72 to the open position 30B while held in a constant posture.

As shown in FIG. 8C and FIG. 8D, the left-side platen support mechanism 40L is configured identically (that is, is plane symmetric) to the right-side platen support mechanism 40R. The same reference numerals used on the right-side platen support mechanism 40R are therefore assigned to the corresponding parts of the left-side platen support mechanism 40L, and further description thereof is omitted.

Note that the shapes of the left and right first to fifth links 51 to 55 do not need to be the same, but the positions of the first to sixth joints 61 to 66 must be symmetric.

The cover mounting frame 46 spans between the bottom surface of the front end part of the platen unit 30 and the bottom end parts of the left and right inside side panels 37, 38. As shown in FIG. 3 and FIG. 4, this cover mounting frame 46 has a bottom frame member 46*a* that is attached to the sides of the left and right inside side panels 37, 38, and a top frame member 46*b* attached to the side of the platen unit 30. The cover 4 is attached to the inside surface of the top frame member 46*b*. The bottom frame member 46*a* and top frame member 46*b* are connected so that they can slide relative to each other, and slide together and apart as the cover 4 (platen unit 30) opens and closes.

Out-of-Plane Rigidity Reinforcement Mechanism of the Six Joint Linkage Mechanism As shown in FIG. 8A and FIG. 8B, in the six joint linkage mechanism 42 on the right side the third and fifth links 53, 55 are disposed along the outside surface (first side), and the first, second, and fourth links 51, 52, 54 are disposed along the inside surface (second side), of the inside side panel 38 (frame panel) with the inside side panel 38 therebetween. The second joint 62 between the outside third and fifth links 53, 55 and the inside fourth link 54 is rendered by a support pin 62*a* extending widthwise to the printer. A curved channel 39 is formed in the inside side panel 38 along the path of support pin 62*a* movement. The support pin 62*a* is fit slidably in this curved channel 39. The first joint 61 between the first and second links 51, 52 on the inside and the fifth link 55 is rendered by a support pin 61*a* disposed on the front outside side of the inside side panel 38.

Because the first to fifth links 51 to 55 rendering the six joint linkage mechanism 42 are thus disposed with the inside side panel 38 therebetween, the out-of-plane rigidity of the linkage mechanism is assured by the inside side panel 38, and sideways deflection of the six joint linkage mechanism 42 widthwise to the printer and chatter can be suppressed when force is applied from the side.

Figure 14:
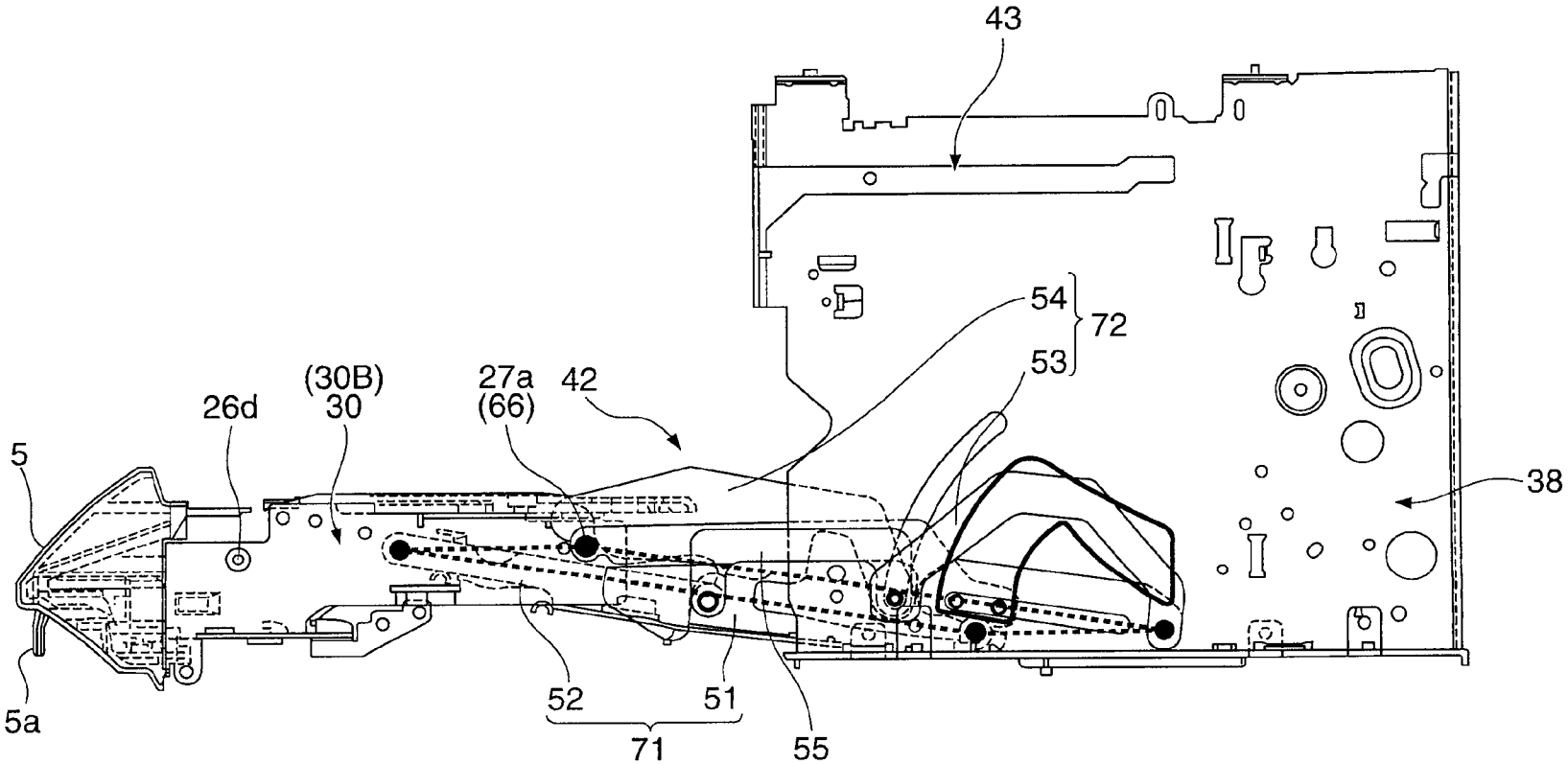
FIG. 14 describes the platen support mechanism in the open position.

More particularly, when the platen unit 30 has moved to the open position 30B in this embodiment of the invention, the complete third link 53 is opposite the outside surface of the inside side panel 38, and approximately half of the fourth link 54 connected thereto is opposite the inside surface of the inside side panel 38 (see FIG. 14). Therefore, even when the platen unit 30 is open, the inside side panel 38 remains held from both sides between the links, and the out-of-plane rigidity of the linkage mechanism is assured by the inside side panel 38 throughout the entire range of movement from the closed position 30A of the platen unit 30 to the open position 30B.

Note that as will be understood from FIG. 8C and FIG. 8D the links of the six joint linkage mechanism 42 on the left side are identically configured, and out-of-plane rigidity is assured.

Opening and Closing the Platen Unit

Figure 9B:
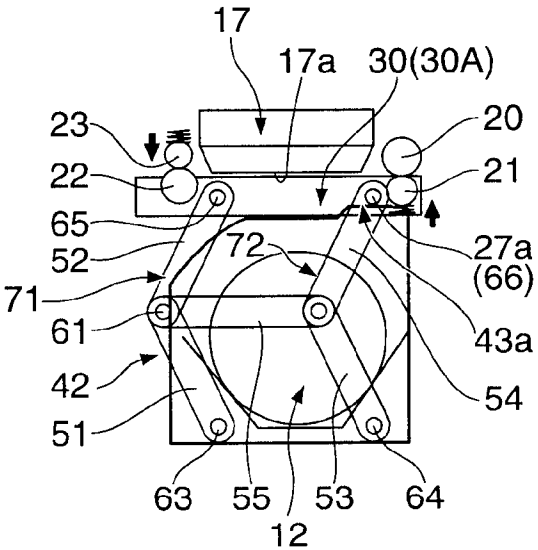
FIG. 9A and FIG. 9B describe the platen support mechanism when in the closed position.
Figure 9A:
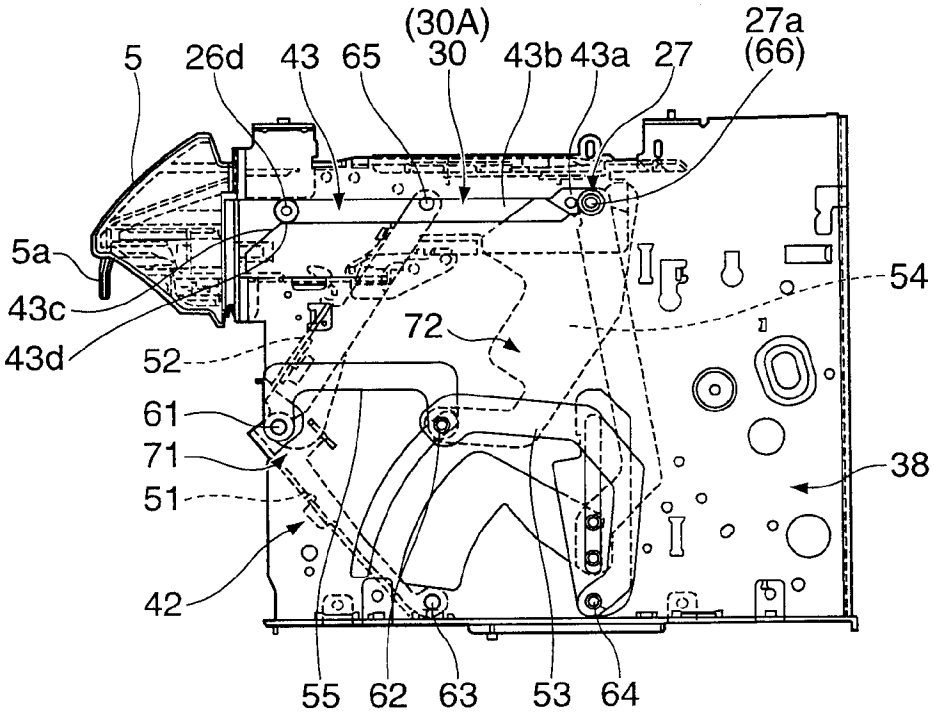

FIG. 9A shows the platen unit 30 in the closed position 30A, and FIG. 9B schematically shows the platen support mechanism in the closed position 30A. In the closed position 30A, the shaft ends 27*a* at the back side of the platen unit 30 ride onto the rear positioning guide channel part 43*a* at the back end of the platen unit guide channel 43 and contact the end of the platen unit guide channel 43. The bosses 26*d* at the front of the platen unit 30 are supported on the front positioning guide channel part 43*d* at the front end of the straight guide channel part 43*b*.

When the platen unit 30 is positioned in the closed position 30A in the specific predetermined posture, the platen 16 mounted on the platen unit 30 is positioned to a position opposite the nozzle surface 17*a* of the print head 17 with a specific gap therebetween. The paper feed follower roller 21 and discharge drive roller 22 mounted on the platen unit 30 are also respectively pressed to the paper feed drive roller 20 and discharge follower roller 23 on the main frame 31 side. The front and back compound links 71, 72 of the six joint linkage mechanism 42 are bent forward and the length of the links is shortened.

When the operating tab 5*a* attached to the front of the platen unit 30 is pulled forward, the lock is released and the operating tab 5*a* is then pulled further forward, the platen unit 30 is pulled along the guide channel 43 to the printer front. As a result, the shaft ends 27*a* of the platen unit 30 move from the rear positioning guide channel part 43*a* to the straight guide channel part 43*b* a step lower, and the bosses 26*d* of the platen unit 30 move from the front positioning guide channel part 43*d* to the inclined guide surface 43*c* side. As a result, the complete platen unit 30 descends a step, and the paper feed follower roller 21 and discharge drive roller 22 move down and away from the paper feed drive roller 20 and discharge follower roller 23 on the main frame 31 side.

Figure 10B:
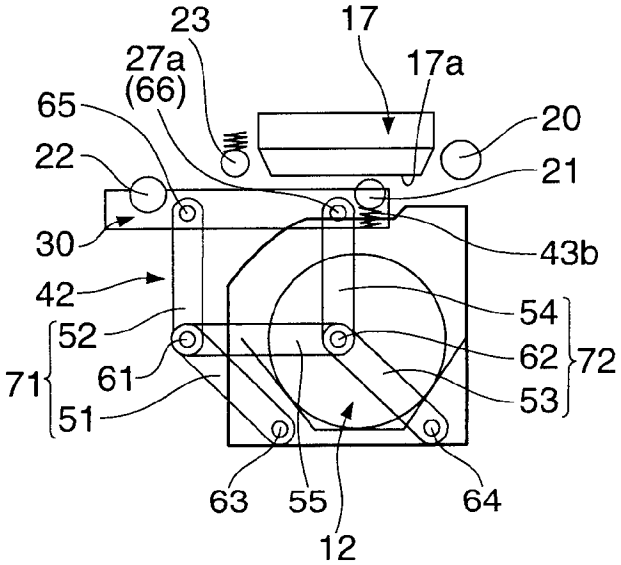
FIG. 10A and FIG. 10B describe the platen support mechanism when beginning to open.
Figure 10A:
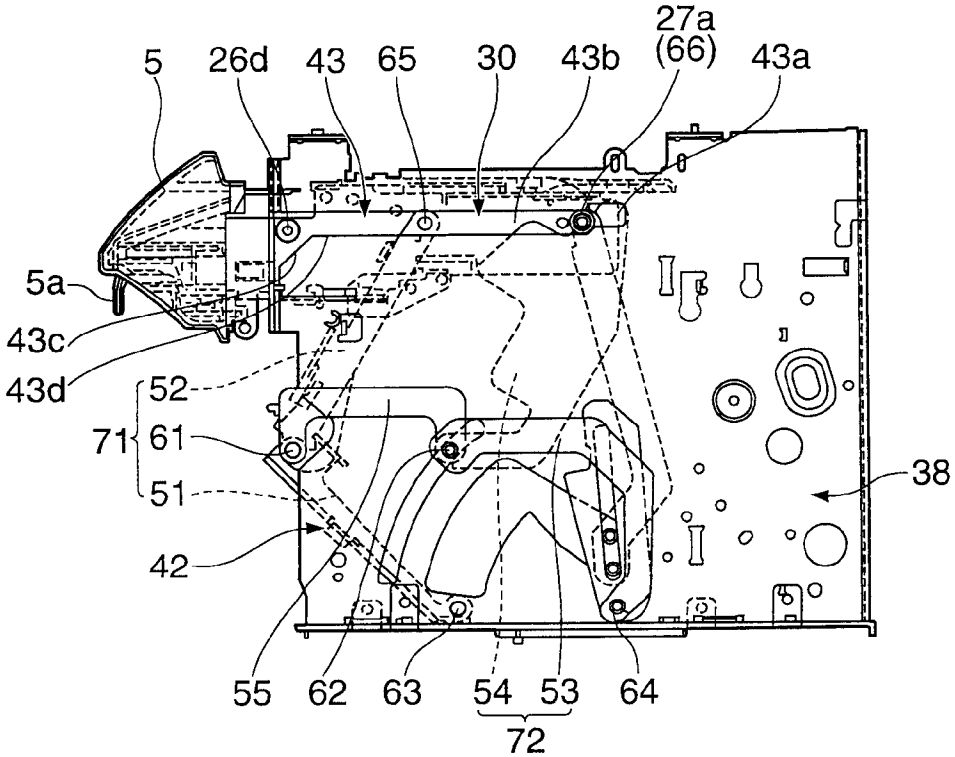

FIG. 10A shows and FIG. 10B schematically describes the platen unit 30 in this position.

Because the platen unit 30 moves forward along the straight guide channel part 43*b* while held in a constant posture by the six joint linkage mechanism 42, the platen unit 30 moves forward without interference with other parts disposed above the platen unit 30 on the main frame 31 side. The platen unit 30 is also configured so that it is pulled forward without interference with the roll paper 12 stored below the platen unit 30.

The platen unit 30 is thus pulled out in a straight line towards the operating direction of the operating force applied to the operating tab 5*a* at the front. Because the platen unit is pulled on a curved path when the platen unit is supported by a four joint parallel linkage mechanism, the direction of the operating force and the direction of platen unit movement are not the same, and the platen unit cannot be pulled out smoothly. In this embodiment of the invention, however, the platen unit 30 can be pulled out smoothly with little operating force along the straight guide channel part 43*b* without being constrained by the linkage mechanism (that is, because the linkage mechanism can expand).

Furthermore, while the platen unit 30 is pulled out along a straight first path S1 (such as the path of the sixth joint pin 66) in this embodiment of the invention, this first path S1 is not limited by the six joint linkage mechanism 42 because the linkage mechanism is not a fixed length. As a result, insofar as there are no problems with operability, the first path S1 is not limited to a straight path, and the platen unit 30 can be pulled along any desired path of movement that is within the extension range of the compound links 71, 72, including a curved path or stepped path, for example.

Figure 11:
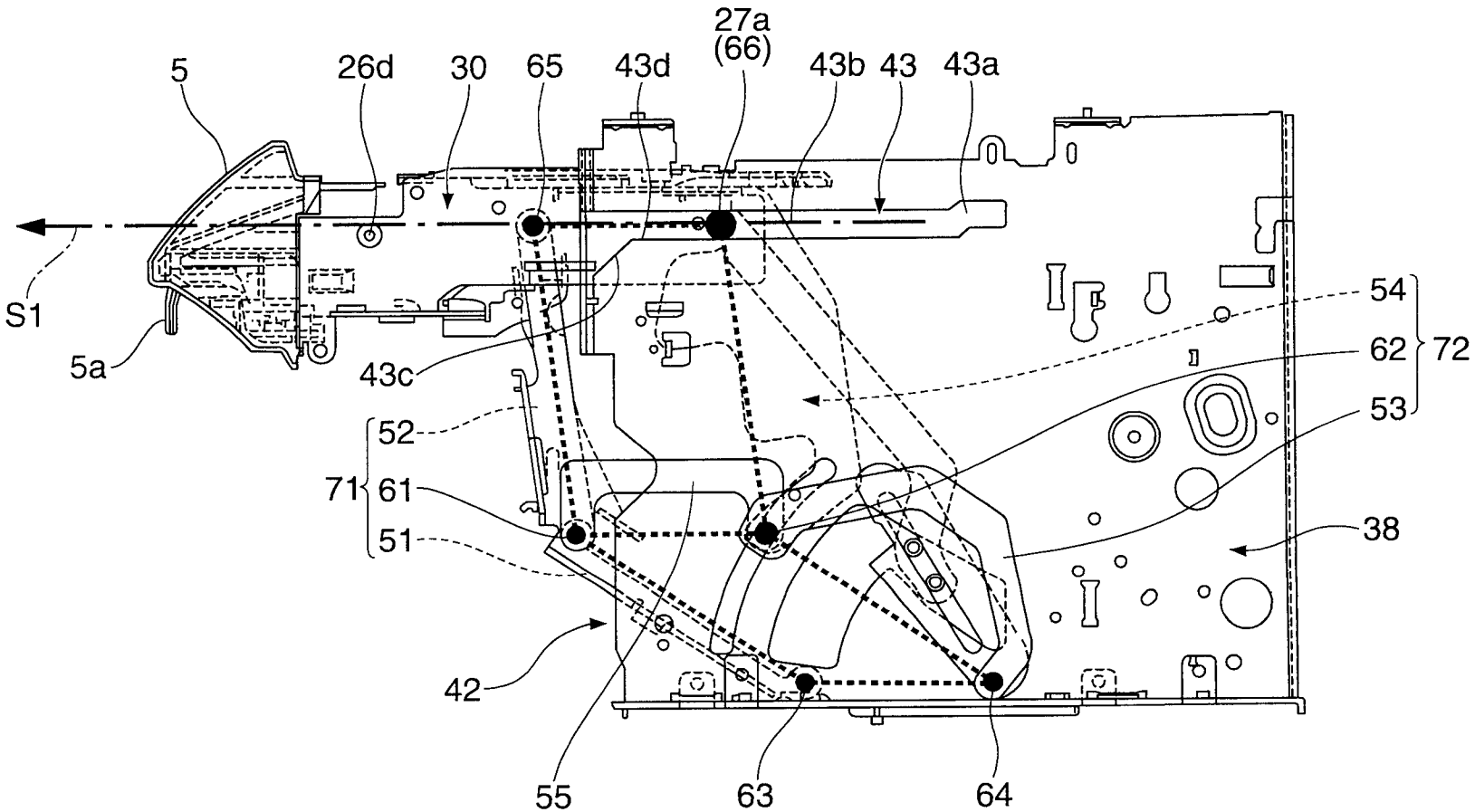
FIG. 11 describes the platen support mechanism when opened to just before a midpoint position.

As shown in FIG. 11, as the platen unit 30 is pulled forward, the first and second compound links 71, 72 gradually extend from the folded curved position. As described above, when the end 27*a* of the support rod 27 on the back side of the platen unit 30 reaches the front end of the straight guide channel part 43*b* of the guide channel 43 (that is, the back end of the inclined guide surface 43*c*), the first and second compound links 71, 72 are fully extended to the maximum linkage length.

Figure 12B:
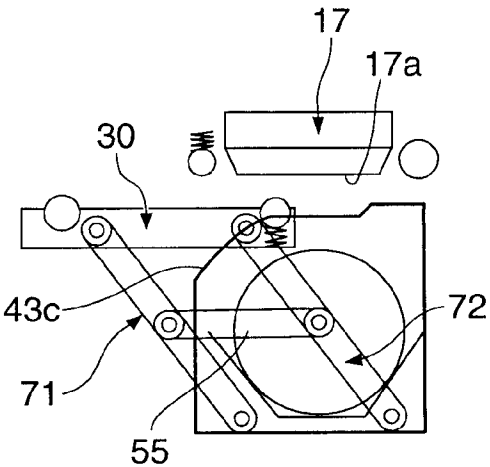
FIG. 12A and FIG. 12B describe the platen support mechanism when opened to the midpoint position.
Figure 12A:
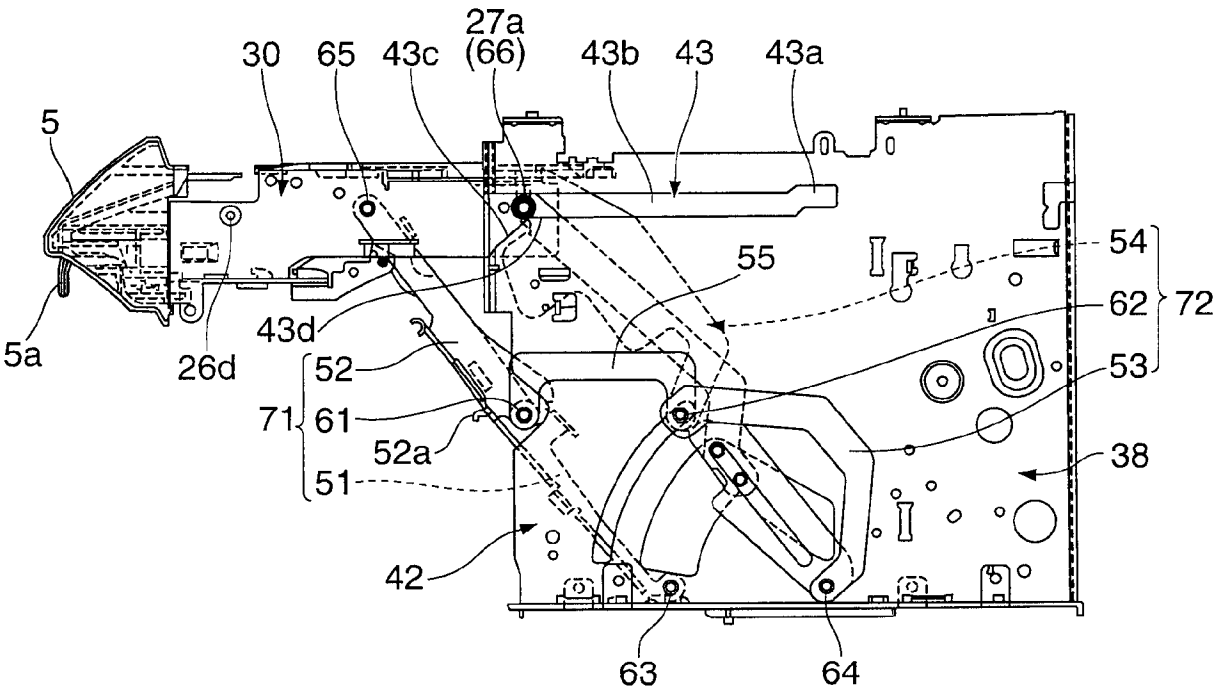

FIG. 12A shows and FIG. 12B schematically describes the platen unit 30 in this position. The platen unit 30 moves forward along the straight first path S1 until the end 27*a* moves from the front end of the straight guide channel part 43*b* to the inclined guide surface 43*c*.

From this position a four joint parallel linkage mechanism is rendered by the fully extended first and second compound links 71, 72. More specifically, the top end of the first link 51 contacts a stop 52*a* formed on the bottom end of the second link 52, and the first compound link 71 is held fully extended. The second compound link 72 linked to the first compound link 71 by the fifth link 55 is also held fully extended, rendering a four-joint parallel linkage mechanism with joints at the third to sixth joints 63 to 66.

The platen unit 30 is then pulled to the forward open position 30B while held in the same posture along the curved second path S2 (such as the path drawn by the sixth joint 66) defined by the first and second compound links 71, 72 functioning as a four-joint parallel linkage mechanism.

Note that the third link 53 and fourth link 54 of the second compound link 72 could be engaged with each other so that they do not curve to the opposite side (back side).

Figure 13B:
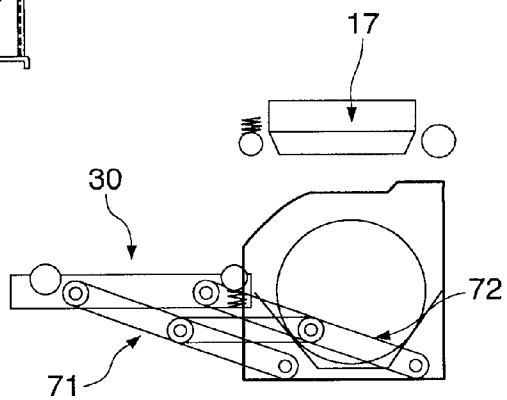
FIG. 13A and FIG. 13B describe the platen support mechanism when opened to just before the open position.
Figure 13A:
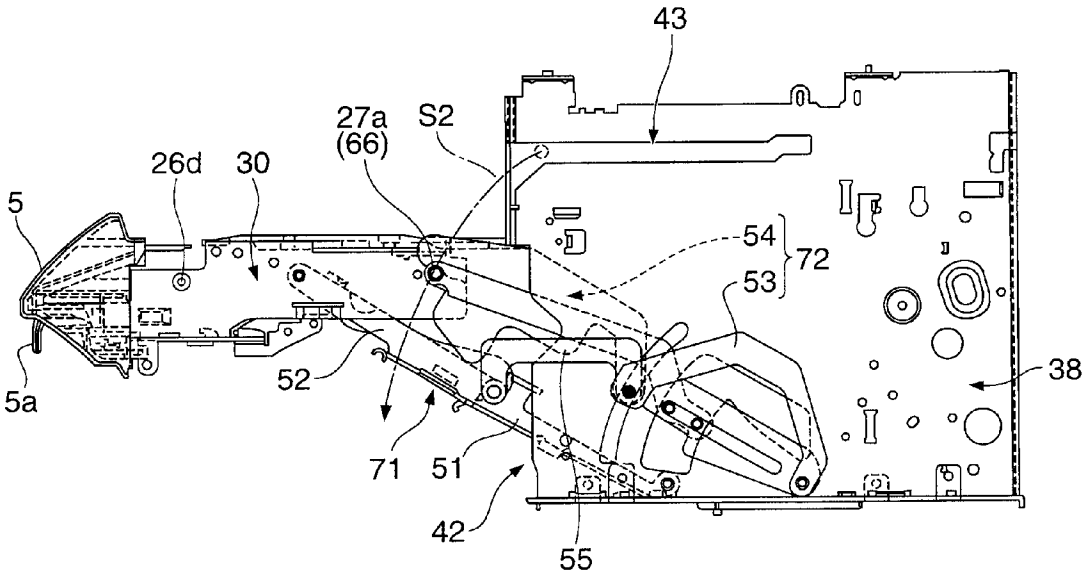

FIG. 13A shows and FIG. 13B schematically describes movement of the platen unit 30 forward when the six joint linkage mechanism 42 functions as a four-joint parallel linkage mechanism. Because the first and second compound links 71, 72 pivot forward when fully extended (when at the maximum link length), the platen unit 30 moves forward along the curved second path S2 with a large radius of curvature. The platen unit 30 can therefore be pulled to the forward open position 30B without interference with the roll paper 12, for example, located therebelow.

FIG. 14 shows the platen unit 30 when pulled out to the open position 30B.

The closing operation whereby the platen unit 30 is closed from the open position 30B to the closed position 30A is the reverse of the opening operation described above. When closing the platen unit 30, the platen unit 30 moves from the open position 30B along the curved second path S2. When the shaft ends 27*a* at the back of the platen unit 30 are then inserted to the platen unit guide channel 43 and reach the front end of the straight guide channel part 43*b*, the platen unit 30 is pushed toward the back of the printer along the straight first path S1.

When the platen unit 30 is pushed to the closed position 30A, the platen unit 30 is positioned in a specific posture by the platen positioning mechanism 41. More specifically, the shaft ends 27*a* at the back of the platen unit 30 ride onto the rear positioning guide channel part 43*a* of the platen unit guide channel 43 and contact the end of the platen unit guide channel 43. At the same time, the bosses 26*d* at the front of the platen unit 30 ride onto the front positioning guide channel part 43*d* at the front of the straight guide channel part 43*b*. As a result, the platen 16 returns to the position shown in FIG. 9A and is positioned to the printing position in a posture with a specified gap to the nozzle surface 17*a* of the print head 17.

Because the platen unit 30 (platen frame 26) on which the platen 16 is carried is positioned by bosses 26*d* on both sides widthwise to the printer at the front of the platen unit 30, and by shaft ends 27*a* on both sides widthwise to the printer at the back of the platen unit 30, tilting of the platen unit 30 in the front-back direction of the printer and tilting widthwise to the printer is controlled. As a result, inclination of the platen 16 is controlled both in the front-back direction of the printer and widthwise to the printer. Therefore, even if play develops in the platen support mechanism, the platen 16 can be constantly positioned to the printing position in a specified posture.

In addition, because the shaft ends 27*a* at the back of the platen unit 30 contact the ends of the platen unit guide channel 43, the platen 16 can be accurately positioned in the front-back direction of the printer.

Other Embodiments of the Invention

Figure 15A:
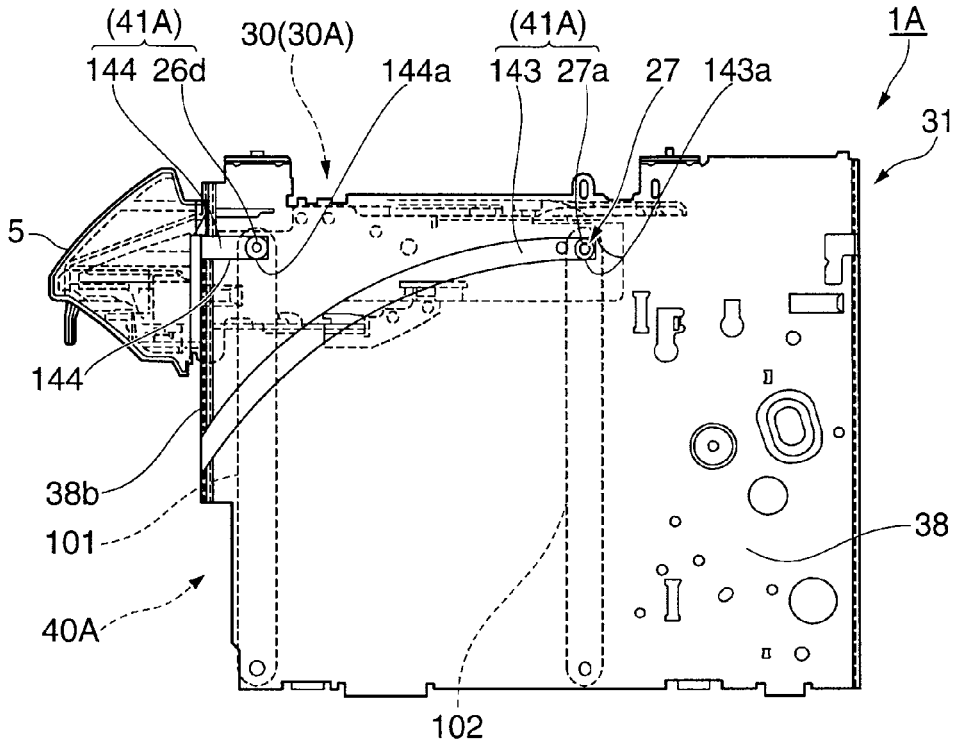
FIG. 15A and FIG. 15B show a roll paper printer according to another embodiment of the invention.
Figure 15B:
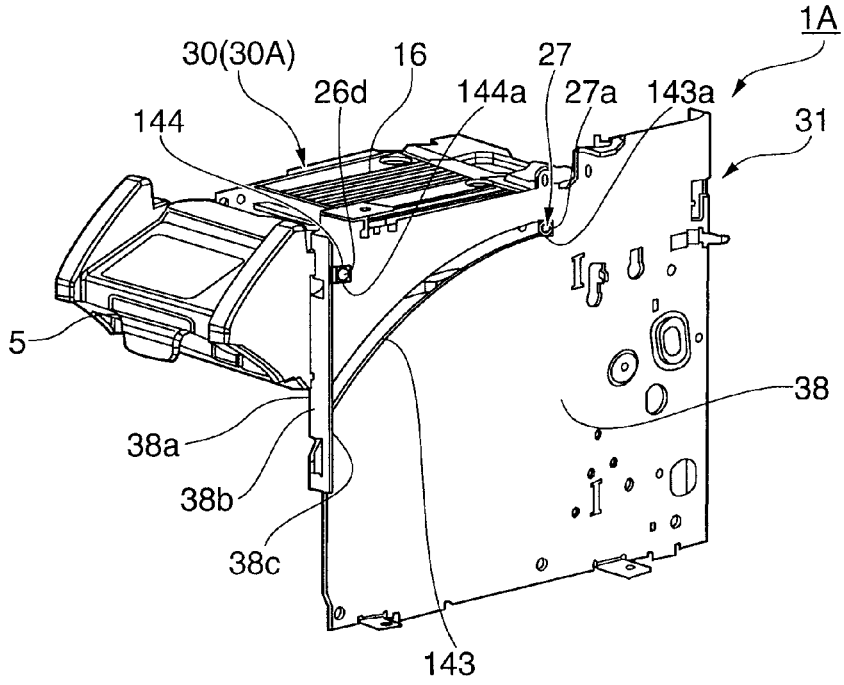

An embodiment applying the invention to a roll paper printer that has a platen support mechanism that supports the platen unit 30 by means of a four joint parallel linkage mechanism is described below. FIG. 15A is a side view showing the main parts of the platen support mechanism of the roll paper printer, and FIG. 15B is an oblique view of the same. Note that in FIG. 15B the four joint parallel linkage mechanism and the left inside side panel are omitted.

The configuration of this roll paper printer 1A is basically the same as the configuration of the roll paper printer 1 described above, and corresponding parts are therefore identified by the same reference numerals.

In this printer 1A the platen support mechanism 40A is rendered by a four joint parallel linkage mechanism including a front link 101 and a back link 102. The bottom ends of these links are connected to joints disposed to the main frame 31 side. The tops ends thereof are connected to the platen unit 30, and more specifically the top ends of the front link 101 are connected to the bosses 26*d* and the top ends of the back link 102 are connected to the support shaft 27 (shaft ends 27*a*).

The platen unit 30 can pivot in the front-back direction of the printer along a curved path of movement along the inside side panels 37, 38 (such as the path drawn by the back shaft ends 27*a*), and the platen 16 moves between the closed position 30A defining the printing position and the open position 30B where the platen 16 is pulled out in front of the main frame 31 while held in a specified posture.

With this four joint parallel linkage mechanism the shaft ends 27*a* at the back of the platen unit 30 and the bosses 26*d* at the front of the platen unit 30 move along different curved paths of movement when the platen unit 30 moves. As a result, the platen positioning mechanism 41A has curved back platen unit guide channels 143 that guide the shaft ends 27*a*, and curved front platen unit guide channels 144 that guide the bosses 26*d*. The shaft ends 27*a* are slidably inserted to the back platen unit guide channels 143, and the bosses 26*d* are slidably inserted to the front platen unit guide channels 144. The back end part of the back platen unit guide channels 143 is a rear positioning guide channel part 143*a*, and the back end part of the front platen unit guide channels 144 is a front positioning guide channel part 144*a*.

The right inside side panel 38 has a flange 38*b* that bends to the outside from the front edge 38*a* of the side panel. The back platen unit guide channel 143 and front platen unit guide channel 144 each have an open end where the flange 38*b* is formed, and are formed extending from the front edge 38*a* toward the back of the printer. Note that the left inside side panel 37 has a flange identically to the right inside side panel 38, and the back platen unit guide channel 143 and the front platen unit guide channel 144 can be formed from this flange in the left inside side panel 37. Alternatively, a reinforcing member similar to the reinforcing member 37*d* described above may be attached near the open ends of the back platen unit guide channels 143 and front platen unit guide channels 144.

In the closing operation that closes the platen unit 30 from the open position 30B to the closed position 30A, the platen unit 30 is held in the same posture while moving along a curved path of movement to the back of the printer. When the platen unit 30 is pushed to the closed position 30A, the platen unit 30 is positioned in a specific posture by the platen positioning mechanism 41. More specifically, the shaft ends 27*a* at the back of the platen unit 30 are positioned in the rear positioning guide channel part 143*a* of the back platen unit guide channels 143 in contact with the end of the channel. At the same time, the bosses 26*d* of the platen unit 30 are positioned in the front positioning guide channel part 144*a* of the front platen unit guide channels 144 in contact with the end of the channel. As a result, the platen 16 is positioned in a specific posture to the printing position as shown in FIG. 15A and FIG. 15B.

In this embodiment of the invention the platen unit 30 (platen frame 26) on which the platen 16 is carried is positioned by the bosses 26*d* on both sides widthwise to the printer at the front of the platen unit 30, and the shaft ends 27*a* on both sides widthwise to the printer at the back of the platen unit 30. As a result, because tilting of the platen unit 30 in the front-back direction of the printer and tilting widthwise to the printer is controlled, inclination of the platen 16 is controlled both in the front-back direction of the printer and widthwise to the printer. Therefore, even if play develops in the platen support mechanism, the platen 16 can be constantly positioned to the printing position in a specified posture.

In addition, because the bosses 26*d* of the platen unit 30 contact the ends of the front platen unit guide channels 144 and the shaft ends 27*a* of the platen unit 30 contact the ends of the back platen unit guide channels 143, the platen 16 is accurately positioned in the front-back direction of the printer.

The foregoing embodiment of the invention applies the invention to a roll paper printer with a roll paper compartment. The invention is not so limited, however, and can also be used in roll paper printers that do not have a roll paper compartment, as well as other types of printers having a platen unit that opens and closes in order to open and close the recording paper transportation path (such as printers that can print on fanfold paper).

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer, comprising:

a platen that determines a printing position of a print head;

a platen frame on which the platen is mounted; and a platen support mechanism that supports the platen frame movably to a closed position, where the platen is positioned to the printing position, and an open position separated from the closed position, and has a platen positioning mechanism that positions the platen frame at four places so that the platen frame is in a predetermined posture at the closed position, the four places including a first front position and a second front position on opposite sides at the front in the opening direction, and a first back position and a second back position on opposite sides at the back in the opening direction;

wherein the platen positioning mechanism includes a first guide channel formed at the first front position on one side of the platen frame and a first side panel part of a main printer frame opposite the first back position, a second guide channel formed at the second front position on the other side of the platen frame and a second side panel part of the main printer frame opposite the second back position, a first front positioning pin and a first back positioning pin respectively disposed at the first front position and the first back position of the platen frame, a second front positioning pin and a second back positioning pin respectively disposed at the second front position and the second back position; and the first front positioning pin and the first back positioning pin are guided by the first guide channel, and the second front positioning pin and the second back positioning pin are guided by the second guide channel, from an intermediate position of platen frame movement toward the closed position, and are thereby respectively positioned to the first front position and the first back position, and the second front position and the second back position, when the platen frame is in the closed position.

2. The printer according to claim 1, wherein the platen frame is positioned in the closing direction to the closed position by the first back positioning pin contacting the end of the first guide channel in the closing direction of the platen frame and the second back positioning pin contacting the end of the second guide channel in the closing direction of the platen frame.

3. The printer according to claim 2, wherein the ends of the first guide channel and the second guide channel in the direction to which the platen frame opens are open ends;

a part where the open end of the first guide channel is formed in the first side panel is reinforced by a reinforcing member without interfering with the first front positioning pin and first back positioning pin; and a part where the open end of the second guide channel is formed in the second side panel part is reinforced by a reinforcing member without interfering with the second front positioning pin and second back positioning pin.

4. The printer according to claim 1, wherein the platen support mechanism has a first front link and a first back link respectively disposed to the first front position and first back position side, and a second front link and a second back link respectively disposed to the second front position and the second back position side, at front and back locations in the opening direction of the platen frame;

the first front link and the second front link are compound links rendered by connecting respective first links and second links in series through a first pin joint;

the first back link and the second back link are compound links rendered by connecting respective third links and fourth links in series through a second pin joint;

a fifth link spans between the first pin joint and the second pin joint; and a six joint parallel linkage mechanism that supports the platen frame on both sides of the platen frame is rendered by the first to fifth links.

5. The printer according to claim 1, wherein the platen support mechanism has a first front link and a first back link respectively disposed to the first front position and first back position side, and a second front link and a second back link respectively disposed to the second front position and the second back position side, at front and back locations in the opening direction of the platen frame; and a four joint parallel linkage mechanism that supports the platen frame on both sides of the platen frame is rendered by these links.

6. The printer according to claim 1, further comprising:

a roll paper compartment that stores roll paper; and an access cover for opening and closing the roll paper compartment;

wherein the platen frame opens and closes in conjunction with opening and closing the access cover.

7. The printer according to claim 1, wherein the platen frame is always positioned to the closed position in a specific posture by the platen support mechanism.

8. The printer according to claim 1, wherein the posture of the platen in the printing position is always controlled to a specific posture.

9. The printer according to claim 1, wherein a constant gap is assured between all parts of a platen surface and the print head.

10. A printer, comprising:

a main frame to which a print head is disposed and which has a first side panel part and second side panel part; and a platen frame that carries a platen that is positioned opposite the print head, can move relative to the main frame, and is disposed between the first side panel part and the second side panel part of the main frame;

wherein the platen frame can move to a first position where the platen is opposite the print head, and a second position where the platen is separated from the print head, and includes a first protrusion and a third protrusion that protrude towards the first side panel of the main frame, and a second protrusion and a fourth protrusion that protrude toward the second side panel of the main frame, the first protrusion and the second protrusion disposed coaxially, and the third protrusion and the fourth protrusion disposed coaxially;

the main frame has on the first side panel part, a first guide unit that guides the first protrusion of the platen frame, and a third guide unit that guides the third protrusion of the platen frame, and on the second side panel part, a second guide unit that guides the second protrusion of the platen frame, and a fourth guide unit that guides the fourth protrusion of the platen frame, the first guide unit has a first stop that contacts the first protrusion when the platen frame is positioned at the first position, and the second guide unit has a second stop that contacts the second protrusion when the platen frame is positioned at the first position; and when the platen frame is positioned to the first position, the first protrusion is supported by the first guide unit and contacts the first stop, the second protrusion is supported by the second guide unit and contacts the second stop, the third protrusion is supported by the third guide unit, and the fourth protrusion is supported by the fourth guide unit.

* * * * *